United States Patent [19]

Aoki et al.

[11] Patent Number: 4,977,956

[45] Date of Patent: Dec. 18, 1990

[54] HEAT EXCHANGER

[75] Inventors: Hisao Aoki, Maebashi; Toru Yamaguchi, Isesaki, both of Japan

[73] Assignee: Sanden Corporation, Gunma, Japan

[21] Appl. No.: 378,002

[22] Filed: Jul. 11, 1989

[30] Foreign Application Priority Data

Jul. 11, 1988 [JP] Japan ..... 63-90911[U]

[51] Int. Cl.[5] ..... F28F 9/02

[52] U.S. Cl. ..... 165/176; 165/153; 165/175; 165/174

[58] Field of Search ..... 165/150, 152, 153, 173, 165/175, 176, 174

[56] References Cited

U.S. PATENT DOCUMENTS

| | | | |
|---|---|---|---|
| 230,815 | 8/1880 | Puffer | 165/176 |
| 2,612,349 | 9/1952 | Lintern . | |
| 2,867,416 | 1/1959 | Lieberherr | 165/176 X |
| 4,206,805 | 6/1980 | Beckett | 165/176 X |
| 4,825,941 | 5/1989 | Hoshino et al. . | |

FOREIGN PATENT DOCUMENTS

| | | | |
|---|---|---|---|
| 1182322 | 6/1959 | France | 165/150 |
| 55-172773 | 12/1980 | Japan . | |
| 63-112065 | 5/1988 | Japan . | |
| 63-113300 | 5/1988 | Japan | 165/176 |

*Primary Examiner*—Martin P. Schwadron
*Assistant Examiner*—Allen J. Flanigan
*Attorney, Agent, or Firm*—Banner, Birch, McKie & Beckett

[57] ABSTRACT

A heat exchanger including a first and second header is disclosed. The headers are linked in fluid communication by a plurality of elongated fluid tubes. In a first embodiment, the first and second headers are integrally formed as a single pipe having a partition wall extending radially across. Left and right intermediate headers are disposed laterally of the single pipe. Two groups of fluid tubes link the first header to a lower portion of the intermediate headers, and two additional groups of fluid tubes link the intermediate headers to an upper portion of the second header. In a second embodiment, the first and second headers are disposed in a spaced parallel arrangement and are approximately half the length of the left and right intermediate headers with which they are linked at an upper portion of the intermediate headers by fluid tubes. The lower parts of the intermediate headers are linked directly by a third group of tubes to complete the fluid circuit of the heat exchanger.

5 Claims, 3 Drawing Sheets

HEAT EXCHANGER

BACKGROUND OF THE INVENTION

1. Technical Field

This invention relates to a heat exchanger, and more particularly, to a heat exchanger including spaced headers interconnected by generally parallel fluid tubes.

2. The Prior Art

Conventional heat exchangers including a first header, a second header and a plurality of parallel fluid tubes which are interconnected between the first and second headers to allow fluid flow therebetween are known in the art. A first and second union joint are connected to one end of the first and second headers, respectively, to link the heat exchanger with other elements of a cooling circuit. In general, the first header acts as an inlet to the exchanger and is disposed on one side of the exchanger at one end of each of the plurality of parallel fluid tubes, and the second header acts as an outlet for the exchanger and is disposed on an opposite side of the exchanger at the opposite ends of the tubes. Accordingly, the overall configuration of the heat exchanger is generally a rectangular shape with the inlet at one corner and the outlet at an opposite corner.

When the heat exchanger is used as part of an automobile air-conditioning cooling circuit, the circuit including the heat exchanger must be disposed in a limited area of the engine compartment. Thus, the heat exchanger must be disposed so as to conform to the predetermined size and shape of an allotted space which are determined by the location of other elements of the cooling circuit and other elements of the engine disposed in the same general area. If the other elements protrude into the limited space of the cooling circuit reserved for the heat exchanger, it might be necessary to make use of a smaller than desired heat exchanger in order to ensure that the exchanger fits into the engine compartment. However, the heat exchanger is linked to the other elements of the cooling circuit by a rubber hose, connected to the exchanger at the union joints extending from the headers. Each union joint has a predetermined length and is made of a hard metal. Thus, the union joints extend from the exchanger for a predetermined length and may not easily be reconfigured. Therefore, even if a smaller exchanger is used, it may not be possible to reduce the necessary size of the predetermined space due to the impossibility of reconfiguring the union joints.

Additionally, even if the use of a smaller than desired heat exchanger in the cooling circuit allows for a reduction in the necessary size of the predetermined space, the use of a smaller exchanger causes a detrimental result in capacity and efficiency of the cooling circuit. That is, if the exchanger is part of an air conditioning system, in order for the air conditioning system to operate efficiently, it must have a smaller than desired capacity due to the limited capacity of the smaller heat exchanger.

SUMMARY OF THE INVENTION

It is an object of the present invention to provide a heat exchanger to be used as part of a cooling circuit such that the heat exchanger may be disposed in an irregularly shaped space in order to fully utilize the available space in which it may be disposed, to maximize the capacity of the cooling system.

A heat exchanger according to the present invention includes a first header having a first (inlet) union joint at one end, and a second header including a second (outlet) union joint at one end. The first and second headers are disposed in a linear arrangement with the union joints at opposite ends. Two intermediate headers are disposed laterally of the first and second headers. A plurality of fluid tubes are disposed in a parallel arrangement and extend on either side of the linear arrangement of the first and second headers. The plurality of fluid tubes are divided into four groups such that two groups link the first header in fluid communication with both intermediated headers, and the other two groups link both intermediate headers in fluid communication with the second header. Corrugated fins are disposed between the fluid tubes.

In operation, fluid flows from an external cooling circuit into the heat exchanger via the inlet union joint and first header, through the first two groups of fluid tubes to the intermediate headers, back to the second header through the second two groups of fluid tubes, and back to the cooling circuit through the outlet union joint. In a second embodiment, the first and second headers are disposed in parallel at a position between the intermediate headers. The first and second headers are approximately half the length of the intermediate headers.

Further object, features and other aspects of this invention will be understood from the following detailed description of the preferred embodiments of this invention with reference to the drawings.

DETAILED DESCRIPTION OF THE PREFERRED EMBODIMENTS

Figure 1:
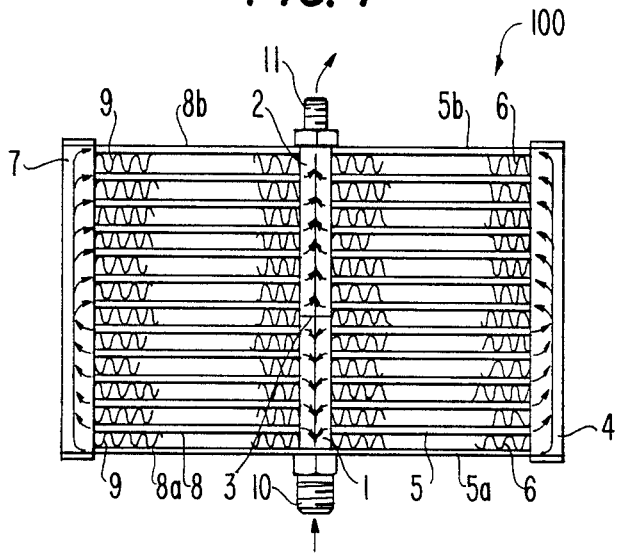
FIG. 1 is a front view of a heat exchanger in accordance with a first embodiment of this invention.

With reference to FIG. 1, a heat exchanger in accordance with a first embodiment of this invention is shown. Heat exchanger 100 includes first header 1 and second header 2 formed integrally as a single pipe divided by central partition wall 3 extending radially across. Headers 1 and 2 serve as input and output headers respectively for exchanger 100 which forms part of a cooling circuit (not shown). The cooling circuit including heat exchanger 100 may be disposed, for example, in the engine compartment of an automobile and may serve as an automobile air conditioning circuit. Right intermediate header 4 is disposed laterally of headers 1 and 2 on one side of exchanger 100, to the right as shown in FIG. 1. Left intermediate header 7 is disposed on an opposite side of headers 1 and 2 from first intermediated header 4, to the left as shown in FIG. 1.

Figure 5:
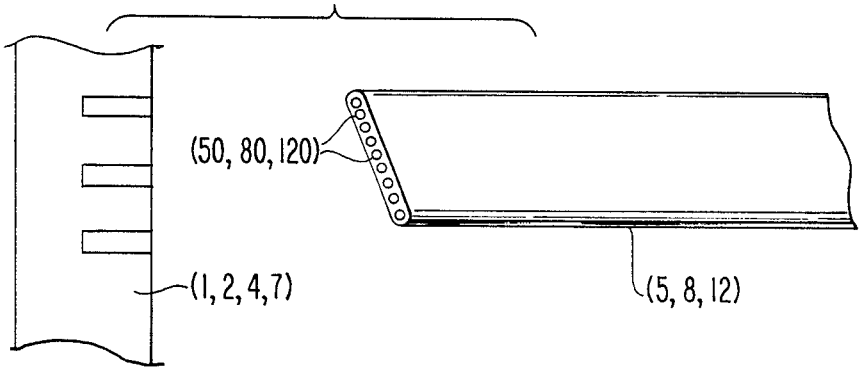
FIG. 5 is a perspective view showing the mating surfaces of the fluid tubes and the headers.

A plurality of parallel and spaced fluid tubes 5 and 8 extend between first and second headers 1 and 2, and first and second intermediate headers 4 and 7. Tubes 5 and 8 have an elongated oval cross-sectional shape with flat upper and lower surfaces as shown in FIG. 5. Tubes 5 and 8 each include a plurality of fluid channels(50, 80, 120) extending therethrough, such that the open ends of each fluid channel of each tube fits about a corresponding projection of the headers. A plurality of corrugated fins 6 and 9 are disposed between each of the opposed outer flat surfaces of each tube of the plurality of tubes 5 and 8. First (inlet) union joint 10 is formed on first header 1, and second (outlet) union joint 11 is formed on second header 2. Each union joint extends from the corresponding header.

Tubes 5 and 8 are divided into four groups for purposes of conveying cooling medium between the headers. Group 5*a* extends between first header 1 and the lower portion of right intermediate header 4. Group 5*b* extends between the upper portion of intermediate header 4 and second header 2. Similarly, group 8*a* extends from the side of first header 1 opposite from group 5*a*, and links first header 1 to the lower portion of left intermediate header 7. Group 8*b* links the upper portion of left intermediate header 7 to second header 2, at a side of second header 2 opposite from group 5*b*.

In operation, the cooling medium of the cooling circuit (not shown) flows into heat exchanger 100 through inlet union joint 10 and first header 1, and then into the fluid tubes of groups 5*a* and 8*a*. The fluid further flows from groups 5*a* and 8*a* into the lower portions of right and left intermediate headers 4 and 7 and then into the upper portions of intermediate headers 4 and 7. Fluid flows from the upper portions of intermediate headers 4 and 7, through groups 5*b* and 8*b*, into second header 2 and exits heat exchanger 100 from outlet union joint 11, and flows back into the other components of the cooling circuit.

Figure 2:
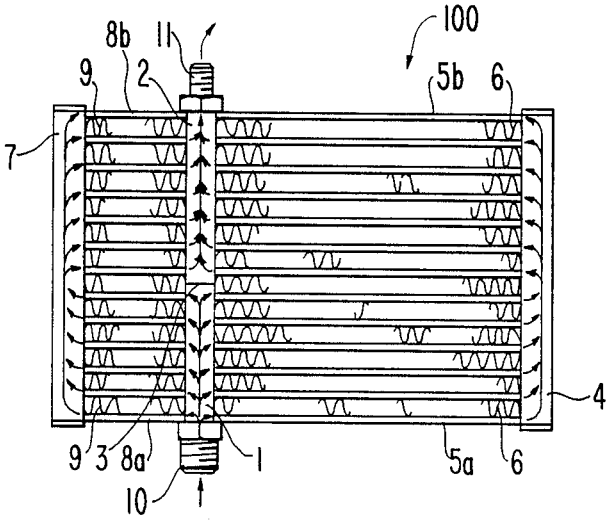
FIG. 2 is a front view of a modified heat exchanger in accordance with a first embodiment of this invention.

With reference to FIG. 2, a modification of the embodiment of FIG. 1 is shown. FIG. 2 is identical to FIG. 1 except that the pipe including headers 1 and 2 is disposed closer to left intermediate header 7 than in FIG. 1. Tubes 8 are correspondingly shorter and tubes 5 are correspondingly longer than in FIG. 1. The overall size of and capacity of the heat exchanger is not changed. However, by making use of the two intermediate headers, the relative location of inlet union joint 10 and outlet union joint 11 can be shifted easily relative to the sides of exchanger 100 to allow the exchanger to be linked to the other elements of the cooling circuit. That is, the location of the union joints is shifted to overcome the obstructions presented by other elements, without requiring a reduction in size of the exchanger. Accordingly, the full space allotted for the exchanger may be utilized.

Figure 3:
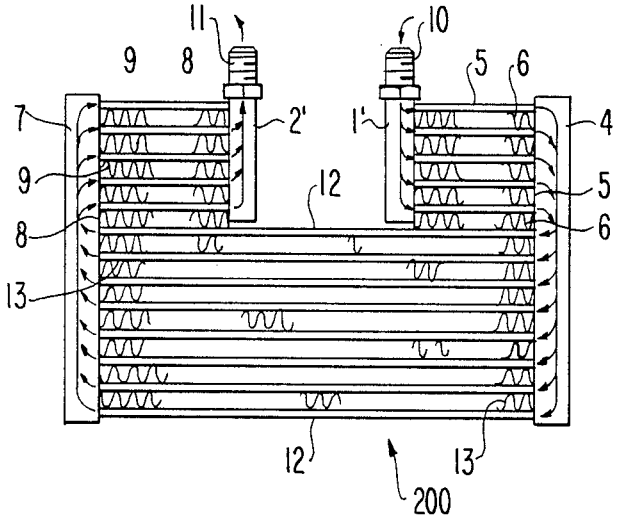

With reference to FIG. 3, heat exchanger 200 in accordance with a second embodiment of this invention is shown. Heat exchanger 200 includes first and second headers 1' and 2', each having approximately half the length of headers 1 and 2 of the heat exchanger shown in FIG. 1. Headers 1' and 2' are non-integrally formed and are disposed approximately equidistantly about a central axis of exchanger 200, with a space maintained therebetween. Right and left intermediate headers 4 and 7 are disposed laterally of first and second headers 1' and 2', respectively. A plurality of flat fluid tubes 5 and 8 extend between first header 1' and the upper portion of header 4, and second header 2' and the upper portion of left intermediate header 7, respectively. Corrugated fins 6 and 9 are disposed between opposing outer flat surfaces of tubes 5 and 8, as in the embodiment of FIG. 1. Union joints (inlet) 10 and (outlet) 11 linking heat exchanger 200 with other components of the cooling circuit, are disposed on first and second headers 1' and 2', respectively.

Right and left intermediated headers 4 and 7 are of substantially the same lengths as in FIG. 1, and are therefore substantially twice the length of headers 1' and 2'. A plurality of fluid tubes 12, which are of the same cross-sectional structure as fluid tubes 5 and 8, extend between the lower portions of right and left intermediate headers 4 and 7, linking them in fluid communication. A plurality of corrugated fins 13 are disposed between opposed outer surfaces of tubes 12.

The operation of heat exchanger 200 is similar to the operation of heat exchanger 100 of FIG. 1. Fluid flows from the external cooling circuit into heat exchanger 200 though union joint 10 and header 1', and into tubes 5. Fluid further flows sequentially into the upper and lower portions of right intermediated header 4, and into the lower portions of left intermediate header 7 through tubes 12. The fluid further flows into the upper portion of left intermediate header 7, through tubes 8 into second header 2', and out of heat exchanger 200 through union joint 11 linked to the cooling circuit.

Figure 4:
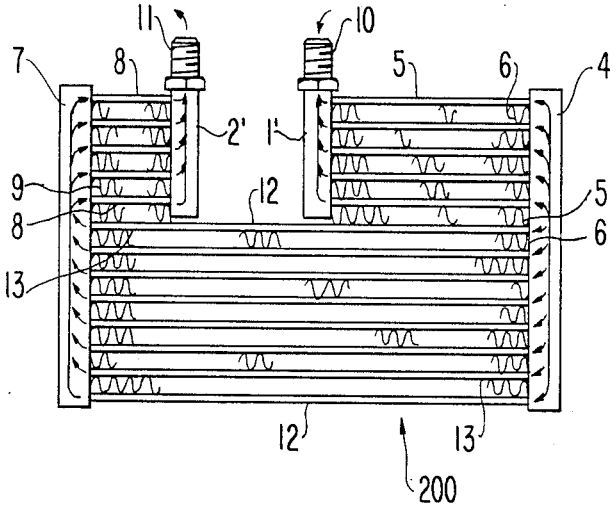
FIG. 4 is a front view of a modified heat exchanger in accordance with a second embodiment of this invention.

With reference to FIG. 4, a modification of the embodiment of FIG. 3 is shown. Headers 1' and 2' have been shifted to the left, as in FIG. 2. Thus, the full space allotted for the exchanger may be utilized as in the first embodiment. Additionally, due to the space maintained between headers 1' and 2', other elements of the cooling circuit or other elements located in the engine compartment may extend into the space without blocking the access to union joints 10 and 11. Thus, a non-rectangular space may be fully used by the exchanger.

This invention has been described in detail in connection with the preferred embodiments. These embodiments, however, are merely for example only and the invention is not restricted thereto. For example, the terms left, right, upper and lower were provided for the sake of convenience of description and are not intended to limit the invention. It will be easily understood by those skilled in the art that variations and modifications can be easily made within the scope of the invention, as defined by the appended claims.

We claim:

1. A heat exchanger comprising:

a first header having a first union joint disposed on one end;

a second header having a second union joint disposed on one end;

at least two intermediate headers disposed laterally on opposite sides of both said first and second headers;

a plurality of fluid tubes disposed between said first header and at least a first of said intermediate headers to link said first header and at least said first intermediate header in fluid communication, and a plurality of tubes disposed between said second header and at least a second of said intermediate headers to link said second header and at least said second intermediate header in fluid communication; and a plurality of corrugated fins disposed between opposed outer surfaces of said fluid tubes.

2. A heat exchanger comprising:

a first header having a first union joint disposed on one end;

a second header having a second union joint disposed on one end;

said first and second headers formed integrally as a single pipe divided by a radial partition wall;

a first intermediate header disposed to the right of said pipe and a second intermediate header disposed to the left of said pipe;

a plurality of fluid tubes disposed between said first header and said first intermediate header to link said first header and said first intermediate header in fluid communication, and a plurality of tubes disposed between said second header and said second intermediate header to link said second header and at least said second intermediate header in fluid communication; and a plurality of corrugated fins disposed between opposed outer surfaces of said fluid tubes.

3. A heat exchanger comprising:

a first header having a first union joint disposed on one end;

a second header having a second union joint disposed on one end, said first and second headers disposed in a parallel spaced arrangement;

at least two intermediate headers disposed laterally of both said first and second headers;

a plurality of fluid tubes disposed between said first header and at least a first of said intermediate headers to link said first header and at least said first intermediate header in fluid communication, and between said second header and at least a second of said intermediate headers to link said second header and at least said second intermediate header in fluid communication; and a plurality of corrugated fins disposed between opposed outer surfaces of said fluid tubes.

4. The exchanger recited in claim 3, said first intermediate header disposed to one side of said first header, and said second intermediate header disposed to the side of said second header opposite said first header.

5. The exchanger recited in claim 4, said plurality of tubes comprising a first group extending between said first header and a first portion of said first intermediate header, a second group extending between said second header and a first intermediate header, a second group extending between said second header and a first portion of said second intermediate header, and a third group extending between portions of said first and second intermediate headers different than said first portions.

* * * * *